United States Patent [19]

Fowler et al.

[11] 4,250,810

[45] Feb. 17, 1981

[54] CENTRIFUGAL CLAMP ON A HIGH SPEED PRINT DRUM

[75] Inventors: Raymond L. Fowler, Boulder, Colo.; David W. Leach, Lexington, Ky.; Lowell T. Sloan, Fort Lauderdale, Fla.

[73] Assignee: International Business Machines Corporation, Armonk, N.Y.

[21] Appl. No.: 78,976

[22] Filed: Sep. 25, 1979

[51] Int. Cl.[3] ..... B41F 21/04; B41F 27/12

[52] U.S. Cl. ..... 101/410; 101/415.1; 101/246; 29/118; 51/367

[58] Field of Search ..... 101/451.1, 409, 410, 101/411, 412, 378, 246; 51/367, 368, 374, 387; 355/16, 13; 271/82, 277, 272; 29/118; 358/291; 346/138

[56] References Cited

U.S. PATENT DOCUMENTS

| | | | |
|---|---|---|---|
| 879,504 | 2/1908 | Wattles | 51/367 |
| 891,857 | 6/1908 | Perry | 101/451.1 X |
| 967,592 | 8/1910 | Wattles | 51/367 |
| 2,046,122 | 6/1936 | Hunt | 51/367 |
| 3,203,074 | 8/1965 | Monaghan | 29/118 |

*Primary Examiner*—J. Reed Fisher

*Attorney, Agent, or Firm*—Homer L. Knearl; J. Jancin, Jr.; Mitchell S. Bigel

[57] ABSTRACT

A clamp for holding a flexible sheet on a rotary carrier tightens the grip on, and pulls, the sheet upon rotation of the carrier, as a result of centrifugal forces generated on two weights attached to two cooperating arms within the clamp. The magnitude of the grip-tightening force is dependent upon the mass of a grip-tightening weight attached to the clamp. The magnitude of the sheet-pulling force is dependent upon the mass of a sheet-pulling weight attached to the clamp. The clamp faces are mounted for concurrent movement along the periphery of the carrier to prevent tearing or other damage to the sheet when it is pulled as the carrier is rotated.

23 Claims, 4 Drawing Figures

CENTRIFUGAL CLAMP ON A HIGH SPEED PRINT DRUM

DESCRIPTION

TECHNICAL FIELD

This invention relates to sheet holding clamps on a rotary carrier or drum generally, and more particularly to clamps having independently variable, centrifugally generated, sheet-pulling and grip-tightening forces.

Various machines require a flexible sheet to be held snugly on a rotary carrier. Examples include, but are not limited to, facsimile machines, copiers, text printing machines and textile printing machines. Generally, a clamp or series of clamps is used to hold the leading edge, the trailing edge or both edges of the sheet on the carrier.

It is desirable for these clamps to tighten the grip of the clamp faces on the edge of the sheet as the carrier rotates, in order to prevent slippage of the sheet with respect to the clamp faces. It is additionally desirable for these clamps to pull the sheet tighter around the carrier as the carrier rotates, to take-up any stretch in the sheet. This sheet stretch may be caused by the rapid rotation of the drum, or by the absorption of fluids (e.g., ink), as the information or pattern is printed on the sheet during rotation.

BACKGROUND ART

In the past, as described in U.S. Pat. No. 3,203,074, a flexible sheet has been held on a rotary carrier by clamping the edge of the sheet between the outer ends of a plurality of leaf springs and a fixed clamping strip. The inner ends of the leaf springs are mounted on a support. In response to the centrifugal force generated by rotation of the carrier, the support moves radially outward. This movement causes the inner ends of the leaf springs to tighten their grip on the edge of the sheet, and to also pull the edge of the sheet along the fixed clamping strip, so as to thereby stretch the sheet on the carrier.

A problem with the prior art clamp is that independent variation of the magnitude of the centrifugally generated grip-tightening force and the sheet-pulling force is not possible. Independent variation of the grip-tightening and sheet-pulling force is highly desirable to accommodate different properties of sheets to be clamped on the rotary carrier.

One type of sheet to be clamped on the carrier may be relatively pliant. Such a sheet requires a small grip-tightening force and a large sheet-pulling force. The grip-tightening force must be small so that the clamp faces will not exert excessive pressure on the edge of the sheet. Excessive pressure can cause permanent deformation of the pliant sheet at the point where the clamp faces grip the sheet. However, the sheet-pulling force must be large enough to take up the pliant sheet's high degree of stretch. If the stretch is not fully taken up, the sheet will not be held tightly as the carrier rotates, and the machine employing the carrier will not function properly. A small grip-tightening force and a large sheet-pulling force is therefore required for a pliant sheet.

Another type of sheet to be clamped on the carrier may be thin and easily torn. Such a sheet requires a large grip-tightening force and a small sheet-pulling force. The grip-tightening force must be large enough to prevent the thin sheet from slipping out of the clamp's grip upon rotation of the carrier. However, the sheet-pulling force must be so small as to prevent the sheet from tearing. A large grip-tightening force and a small sheet-pulling force is therefore required for a thin, easily torn sheet.

Other sheets may have still other properties that require different proportions of grip-tightening and sheet-pulling forces. The ability to independently vary the magnitude of the grip-tightening force and the sheet-pulling force is thus a highly desirable feature to accommodate different properties of sheets.

As discussed hereinabove with respect to the prior art clamp, the sheet is stretched by leaf springs pushing the inner surface of the sheet along a fixed clamping strip. Pushing only the inner surface of the sheet may cause the sheet to tear. This can be avoided by moving cooperating clamp faces (on opposite surface sides of the sheet) concurrently, when stretching the sheet.

Pushing only the inner surface of the sheet may also cause the edge of the sheet to abut against a support of the fixed clamping strip, thereby buckling the sheet's edge. It is desirable to move both cooperating clamp faces concurrently when stretching the sheet to minimize the risk of sheet buckling.

DISCLOSURE OF INVENTION

It is an object of the invention to provide an improved sheet holding clamp.

It is another object of the invention to provide a clamp in which the magnitudes of the centrifugally generated grip-tightening force and sheet-pulling force are independently variable.

It is a further object of the invention to provide a clamp which pulls both the outer and inner surfaces of the sheet concurrently, to prevent tearing or buckling of the sheet.

These objects are accomplished by a clamp having faces for gripping the inner and outer surfaces of the sheet mounted so that both faces can move concurrently along the peripheral surface of the rotary carrier.

Upon rotation of the carrier, a first centrifugal force tightens the grip of the clamp on the sheet. A second centrifugal force pulls the sheet by moving both clamp faces concurrently in a direction to tighten the sheet on the carrier.

In a first embodiment, a grip-tightening weight is attached to that part of the clamp which grips the outer surface of the sheet and a sheet-pulling weight is attached to that part of the clamp which grips the inner surface of the sheet. In a second embodiment, a grip-tightening weight is attached to that part of the clamp which grips the inner surface of the sheet and a sheet-pulling weight is attached to that part of the clamp which grips the outer surface of the sheet.

In either embodiment, upon rotation of the carrier, a first centrifugal force, proportional to the mass of the grip-tightening weight tightens the grip of the clamp on the sheet. A second centrifugal force, proportional to the mass of the sheet-pulling weight pulls the sheet by moving both clamp faces concurrently in a direction to tighten the sheet on the carrier.

BEST MODES FOR CARRYING OUT THE INVENTION

Figure 1:
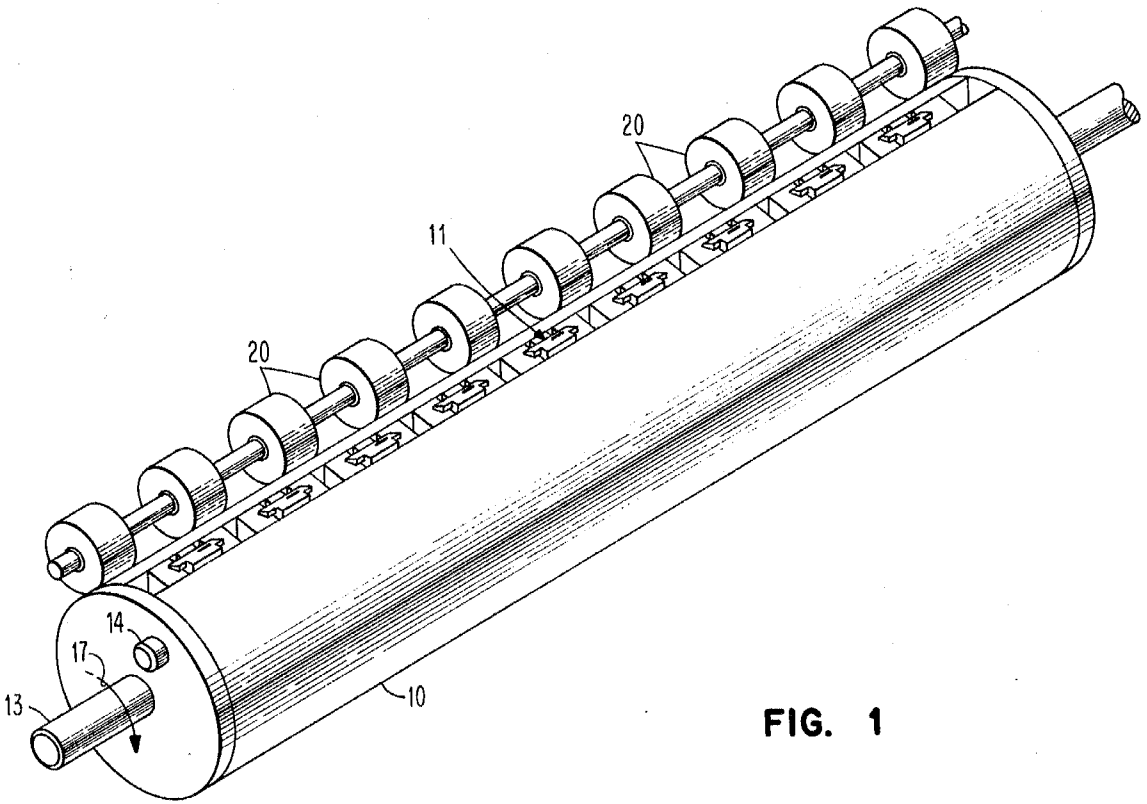
FIG. 1 is a view of a printing drum, having nine leading edge centrifugal clamps on its periphery.

The preferred embodiments of our invention are described with reference to a facsimile machine having a printing drum 10 (see FIG. 1). However, the centrifugal clamp may be used in any machine requiring the clamping of a flexible sheet on a rotary carrier.

Drum 10 is mounted on shaft 13 for rotation in the direction of arrow 17 by a motor or other suitable means (not shown). Rollers 20 guide paper 12 (not shown in FIG. 1) around the peripheral surface of drum 10 when paper 12 is initially mounted on the carrier. Camshaft 14 extends the length of drum 10, and has a series of cams 16 (see FIG. 2) thereon. One cam is associated with each centrifugal clamp 11, to open clamp 11 for receipt of the edge of sheet 12, as described below.

In FIG. 1, nine centrifugal clamps 11 are used as leading edge clamps on printing drum 10. It should be recognized that the centrifugal clamp of the present invention may be used as a leading edge clamp, or as a trailing edge clamp. Two sets of centrifugal clamps may be used as both leading edge and trailing edge clamps on a single printing drum. As an alternative to the nine clamps shown in FIG. 1, one clamp may be employed along the entire length of the drum 10 to grip an entire edge of sheet 12.

Figure 2:
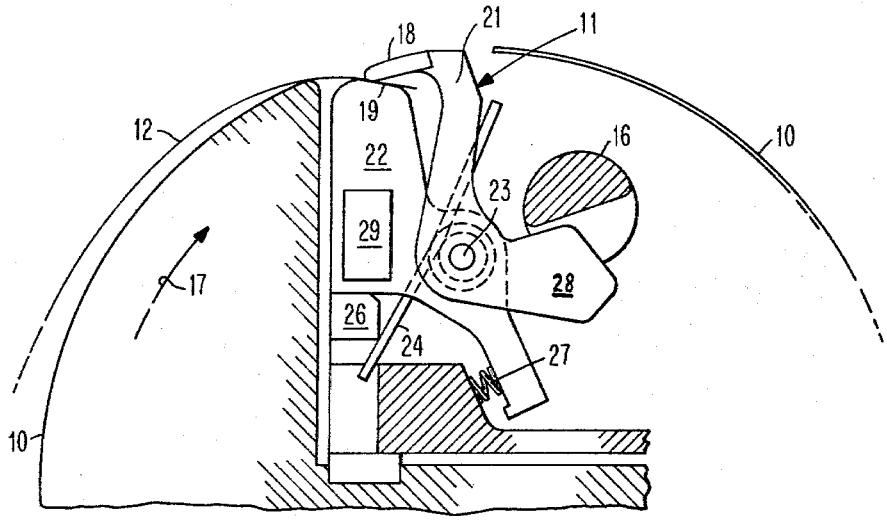
FIG. 2 is a cross sectional view of a centrifugal clamp of FIG. 1.

FIG. 2 is a cross sectional view of one of the centrifugal clamps of FIG. 1. Sheet 12 is mounted on drum 10 for rotation in the direction of arrow 17. Centrifugal clamp 11 is shown gripping the leading edge of sheet 12.

Clamp 11 has two cooperating faces which grip sheet 12. Outer gripping face 18 grips the outer surface of sheet 12. Inner gripping face 19 grips the inner surface of sheet 12. The terms outer and inner do not refer to the location of the faces relative to drum 10 but rather refer to that surface of sheet 12 which the respective faces grip.

Connected to outer gripping face 18 is outer mounting arm 21. Connected to inner gripping face 19 is inner mounting arm 22. The terms outer and inner do not refer to the location of the arms relative to drum 10 but rather refer to the face 18 or 19 to which the arm 21 or 22 is connected.

Inner mounting arm 22 and outer mounting arm 21 are mounted for movement about a common pivot 23. It should be understood that each mounting arm may be mounted on a separate pivot. Alternatively, no pivot at all may be used if the mounting arms per se are flexible. The only constructional requirement for mounting arms 21 and 22 and mounting means 23 is that limited concurrent movement in a single direction be possible of inner and outer gripping faces 19 and 18.

Clamp 11 further includes bias means 24, here a wrap-around spring, that is wrapped around common pivot 23. Spring 24 creates a biasing torque or force in a counterclockwise direction for biasing outer gripping face 18 against inner gripping face 19.

Camshaft 14 (see FIG. 1) may be rotated counterclockwise from the position shown in FIG. 2 to engage cam 16 and outer mounting arm 21. Outer mounting arm 21 pivots in a clockwise direction about pivot 23, against the bias force developed by spring 24. This separates outer gripping face 18 from inner gripping face 19, and creates an opening for insertion or removal of sheet 12. While the clamp is open, inner mounting arm 22 is held in place against stop 26 by a spring 27.

To close the clamp, camshaft 14 is rotated clockwise to the position shown in FIG. 2. Outer mounting arm 21 moves counterclockwise about pivot 23 under the bias force of spring 24, until inner gripping face 19 and outer gripping face 18 cooperatively grip opposite sides of sheet 12.

Attached to outer mounting arm 21 is grip-tightening weight 28, and attached to inner mounting arm 22 is sheet-pulling weight 29. Each weight may consist of a single discrete mass (e.g., weight 29 of FIG. 2). Alternatively, each weight may consist of a plurality of discrete masses of material. Each discrete weight may be mounted for simple removal from its mounting arm for purposes of substituting different weights (e.g., weight 49 of FIG. 3, as described below). Alternatively, each discrete weight may be embedded within its respective mounting arm (e.g., weight 29 of FIG. 2). Each weight may be formed as extensions of outer or inner mounting arms 21 and 22, respectively, rather than as discrete masses of material (e.g., weight 28 of FIG. 2). The mass of such a weight is determined by the size and shape of material added as an extension of mounting arm 21 or 22.

The function of grip-tightening weight 28 will now be described at a time when cam 16 does not engage mounting arm 21. When drum 10 rotates in a clockwise direction (as per arrow 17), grip-tightening weight 28 is subject to a centrifugal force that tends to propel weight 28 radially outward. The centrifugal force on grip-tightening weight 28 manifests itself on outer mounting arm 21 and outer gripping face 18 as a counterclockwise grip-tightening force. This counterclockwise grip-tightening force is additive with the counterclockwise bias force created by spring 24 on outer mounting arm 21. Accordingly, outer gripping face 18 grips sheet 12 more tightly than it would, due to the effect of the bias force alone. The tightening force is only present upon rotation of the drum. The magnitude of the tightening force is proportional to the mass of grip-tightening weight 28.

The function of sheet-pulling weight 29 will now be described. When drum 10 rotates clockwise, in the direction of arrow 17, sheet-pulling weight 29 is subject to a centrifugal force that tends to propel weight 29 radially outward. The centrifugal force on sheet-pulling weight 29 manifests itself on inner mounting arm 22 as a clockwise sheet-pulling force. This clockwise sheet-pulling force pivots inner mounting arm 22 in a clockwise direction, against the action of spring 27. Inner mounting arm 22 pivots away from rest stop 26 in a clockwise direction so that inner mounting face 19 moves substantially along the peripheral surface of drum 10 in a clockwise direction. Because of the mounting arrangement of inner and outer mounting arms 22 and 21, respectively, outer gripping face 18 also moves substantially along the peripheral surface of drum 10 in a clockwise direction.

As face 18 and face 19 pivot concurrently (i.e., with no relative motion between them), edge of sheet 12 is pulled in a clockwise direction. This takes up any sheet stretching that occurs upon rotation of drum 10. Such pulling force is only present upon rotation of the drum. The magnitude of the pulling force is proportional to the mass of sheet-pulling weight 29.

The concurrent movement of cooperating faces 18 and 19 need not occur in a direction substantially along the peripheral surface of drum 10. It may occur in any specified direction consistent with the clockwise pivoting of inner mounting arm 22 and outer mounting arm 21. The only requirement is that movement of the faces be concurrent in a single direction, with no relative motion between them, so as not to tear or damage sheet 12. The preferred direction of movement is substantially along the peripheral surface of drum 10. This direction minimizes the bending or creasing of sheet 12 as it is pulled.

The magnitude of the grip-tightening force is proportional to the mass of grip-tightening weight 28. The magnitude of the sheet-pulling force is proportional to the mass of sheet-pulling weight 29. Thus, the tightening and pulling forces may be independently varied by increasing or decreasing the mass of grip-tightening weight 28 or sheet-pulling weight 29, respectively.

Figure 3:
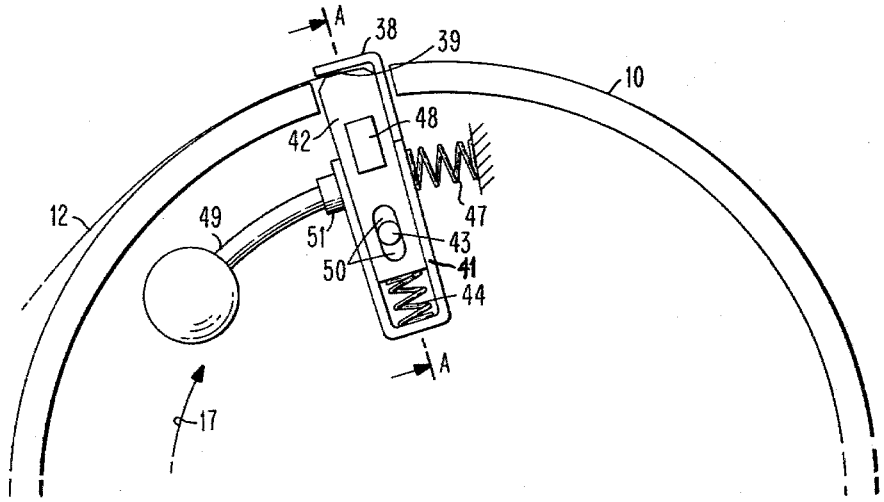
FIG. 3 is a cross sectional view of a second embodiment of the centrifugal clamp.
Figure 4:
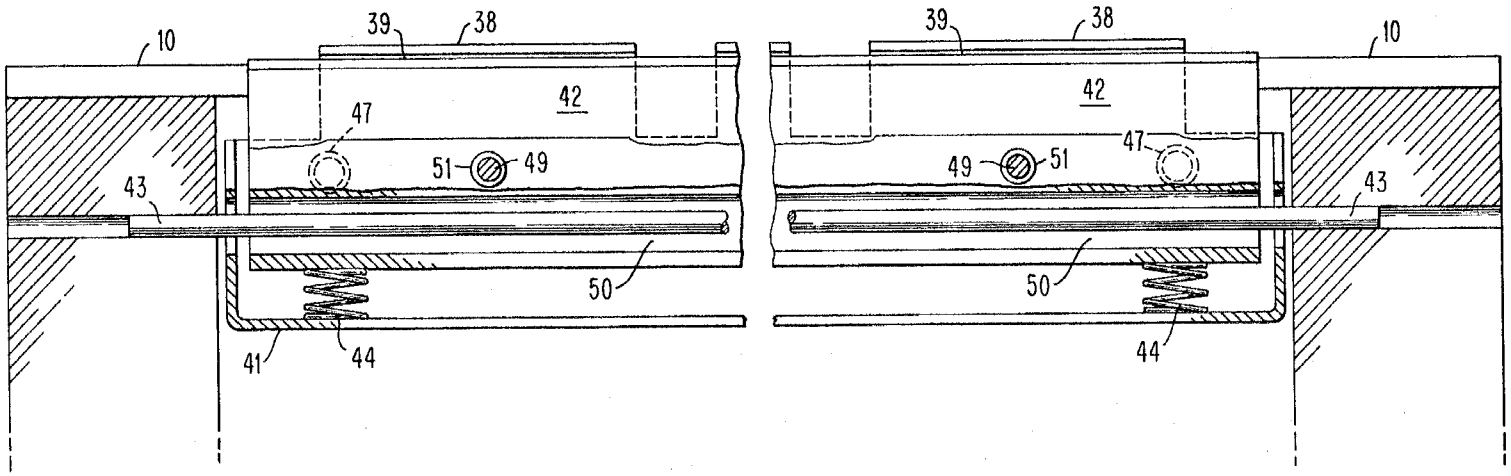
FIG. 4 is a section along line A—A of the centrifugal clamp of FIG. 3.

A second embodiment of the centrifugal clamp is shown in FIGS. 3 and 4. In this embodiment, a single clamp is employed along the entire length of drum 10 to grip the entire leading edge of sheet 12. As in the first embodiment, outer mounting arm 41 is connected to outer gripping face 38, and inner mounting arm 42 is connected to inner gripping face 39. Inner mounting arm 42 and outer mounting arm 41 are mounted for pivotal movement about common pivot 43.

In this embodiment, inner mounting arm 42 is a radially extending member. Outer mounting arm 41 substantially encloses inner mounting arm 42 (see FIG. 3). Outer mounting arm 41 is held by pivot 43 at both ends of drum 10 (see FIG. 4). Sufficient clearance 50 about pivot 43 must be provided in inner mounting arm 42. This clearance 50 enables radially inward retraction of inner mounting arm 42, by a suitable means not shown, to open the clamp for receipt of the edge of sheet 12.

Bias means 44, consists of a spring at each end of drum 10, between inner mounting arm 42 and outer mounting arm 41. These springs 44 create a bias force in the radially outward direction to bias inner gripping face 39 against outer gripping face 38. A spring 47, at each end of drum 10 holds outer mounting arm 41 in place when drum 10 is stationary.

Grip-tightening weight 48 is attached to inner mounting arm 42 by embedding discrete weight 48 within inner mounting arm 42. Two sheet-pulling weights 49 are attached to outer mounting arm 41, one at each end of drum 10. Weights 49 are mounted on outer mounting arm 41 by means of threaded collar 51. This permits simple removal by unscrewing weights 49 from outer mounting arm 41 for purposes of substituting different weights. Any other mounting means permitting simple removal may be employed.

When drum 10 rotates in a clockwise direction (as per arrow 17), grip-tightening weight 48 is subject to a centrifugal force, tending to propel weight 48 radially outward. This centrifugal force manifests itself on inner gripping face 39 as a radially outward grip-tightening force. The grip-tightening force is additive with the radially outward bias force created by spring 44 on inner mounting arm 42. Accordingly, inner gripping face 39 grips sheet 12 more tightly than it would, due to the effect of the bias force alone.

When drum 10 rotates in a clockwise direction (as per arrow 17), sheet-pulling weights 49 are subject to centrifugal forces tending to propel weights 49 radially outward. The centrifugal forces on sheet-pulling weights 49 manifest themselves on outer mounting arm 41 as a clockwise sheet-pulling force. This clockwise sheet-pulling force pivots outer mounting arm 41 in a clockwise direction, against the action of springs 47. Outer gripping face 38 moves substantially along the peripheral surface of drum 10 in a clockwise direction. Inner gripping face 39 also moves substantially along the peripheral surface of drum 10 in a clockwise direction. Faces 38 and 39 pivot concurrently, i.e., there is not relative motion between them. Edge of sheet 12 is pulled in a clockwise direction by the concurrent movement of faces 38 and 39. This takes up any sheet stretching that occurs upon rotation of drum 10.

Whereas we have illustrated and described the preferred embodiments of our invention, it is to be understood that wo do not limit ourselves to the precise constructions herein disclosed and the right is reserved to all changes and modifications coming within the scope of the invention as defined in the appended claims.

We claim:

1. In a machine having a rotary carrier, apparatus for tightening the grip on and pulling an edge of a flexible sheet held on said rotary carrier comprising;

a clamp, having outer gripping means for gripping the outer surface of said flexible sheet, inner gripping means for gripping the inner surface of said flexible sheet, and means for biasing said outer gripping means and said inner gripping means against one another to grip said edge of said flexible sheet on said rotary carrier, means for mounting said clamp for limited concurrent movement of said inner gripping means and said outer gripping means in a single direction, and means for rotating said rotary carrier to produce a first centrifugal force between said inner and outer gripping means and a second centrifugal force on said clamp, said first centrifugal force producing a grip-tightening force between said inner and outer gripping means in a direction additive to the force developed by said biasing means so as to tighten the grip of said clamp on the edge of said flexible sheet, and said second centrifugal force producing a sheet-pulling force on said clamp to cause said inner gripping means and said outer gripping means to move concurrently, so that said clamp pulls upon the edge of said sheet so as to stretch said sheet tightly on said rotary carrier.

2. In a machine having a rotary carrier, apparatus for tightening the grip on and pulling an edge of a flexible sheet held on said rotary carrier comprising:

a clamp, having outer gripping means for gripping the outer surface of said flexible sheet, inner gripping means for gripping the inner surface of said flexible sheet, and means for biasing said outer gripping means and said inner gripping means against one another to grip said edge of said flexible sheet on said rotary carrier, means for mounting said clamp for limited concurrent movement of said inner gripping means and said outer gripping means in a single direction, a grip-tightening weight, a sheet-pulling weight, and means for rotating said rotary carrier to produce a first centrifugal force on said grip-tightening weight and a second centrifugal force on said sheet-pulling weight, said first centrifugal force producing a grip-tightening force between said inner and outer gripping means in a direction additive to the force developed by said biasing means so as to tighten the grip of said clamp on the edge of said flexible sheet, and said second centrifugal force producing a sheet-pulling force on said clamp to cause said inner gripping means and said outer gripping means to move concurrently, so that said clamp pulls upon the edge of said sheet so as to stretch said sheet tightly on said rotary carrier.

3. The apparatus of claim 2 where said grip-tightening weight is a discrete mass of material attached to said clamp.

4. The apparatus of claim 2 where said grip-tightening weight is a plurality of discrete masses of material attached to said clamp.

5. The apparatus of claim 3 or 4 further including means for mounting said grip-tightening weight to permit simple removal of said weight from said clamp.

6. The apparatus of claim 2 where said sheet-pulling weight is a discrete mass of material attached to said clamp.

7. The apparatus of claim 2 where said sheet-pulling weight is a plurality of discrete masses of material attached to said clamp.

8. The apparatus of claim 6 or 7 further including means for mounting said sheet-pulling weight to permit simple removal of said weight from said clamp.

9. The apparatus of claim 2 where said grip-tightening weight is a discrete mass of material embedded within said clamp.

10. The apparatus of claim 2 where said sheet-pulling weight is a discrete mass of material embedded within said clamp.

11. The apparatus of claim 2 where said grip-tightening weight is an extension of said clamp, the mass of said grip-tightening weight dependent upon the size and shape of said extension.

12. The apparatus of claim 2 where said sheet-pulling weight is an extension of said clamp, the mass of said sheet-pulling weight dependent upon the size and shape of said extension.

13. The apparatus of claim 2 further comprising opening means, said opening means moving said outer gripping means and said inner gripping means away from each other to form an opening for receiving said flexible sheet.

14. In a machine having a rotary carrier, apparatus for tightening the grip on and pulling the edge of a flexible sheet held on said rotary carrier comprising:

an outer gripping face for gripping the outer surface of said flexible sheet, an inner gripping face for gripping the inner surface of said flexible sheet, an outer mounting arm connected at one end to said outer gripping face, an inner mounting arm connected at one end to said inner gripping face, means for pivotally mounting said outer mounting arm and said inner mounting arm for limited concurrent movement of said outer gripping face and said inner gripping face substantially along the peripheral surface of said rotary carrier, means for biasing said outer mounting arm towards said inner mounting arm to thereby bias said outer gripping face against said inner gripping face to form a clamp for gripping an edge of said flexible sheet on said rotary carrier, a grip-tightening weight attached to said outer mounting arm, a sheet-pulling weight attached to said inner mounting arm, means for rotating said rotary carrier to produce a first centrifugal force on said grip-tightening weight, and a second centrifugal force on said sheet-pulling weight, said first centrifugal force producing a grip-tightening force on said inner gripping face in a direction additive to the force developed by said biasing means so as to tighten the grip of said inner gripping face and said outer gripping face on the edge of said flexible sheet, and said second centrifugal force producing a sheet-pulling force on said inner mounting arm in a direction to cause said inner mounting arm to pivot, and thereby cause said inner gripping face and said outer gripping face to move concurrently in a direction substantially along the peripheral surface of said rotary carrier so as to pull said edge to stretch said sheet tightly on said carrier.

15. The apparatus of claim 14 where said grip-tightening weight is an extension of said outer mounting arm, the mass of said grip-tightening weight dependent upon the size and shape of said extension.

16. The apparatus of claim 14 where said sheet-pulling weight is a discrete mass of material embedded within said inner mounting arm.

17. The apparatus of claim 14 further comprising a stop and means to hold said inner mounting arm against said stop.

18. The apparatus of claim 14 further comprising opening means, said opening means pivoting said outer mounting arm so that said outer gripping face moves away from said inner gripping face to form an opening for receiving said flexible sheet.

19. In a machine having a rotary carrier, apparatus for tightening the grip on and pulling the edge of a flexible sheet held on said rotary carrier comprising:

an outer gripping face for gripping the outer surface of said flexible sheet, an inner gripping face for gripping the inner surface of said flexible sheet, an outer mounting arm connected at one end to said outer gripping face, an inner mounting arm connected at one end to said inner gripping face, means for pivotally mounting said outer mounting arm and said inner mounting arm for limited concurrent movement of said outer gripping face and said inner gripping face substantially along the peripheral surface of said rotary carrier, means for biasing said inner mounting arm towards said outer mounting arm to thereby bias said inner gripping face against said outer gripping face to form a clamp for gripping an edge of said flexible sheet on the periphery of said rotary carrier.

a grip-tightening weight attached to said inner mounting arm, a sheet-pulling weight attached to said outer mounting arm, means for rotating said rotary carrier to produce a first centrifugal force on said grip-tightening weight, and a second centrifugal force on said sheet-pulling weight, said first centrifugal force producing a grip-tightening force on said inner gripping face in a direction additive to the force developed by said biasing means so as to tighten the grip of said inner gripping face and said outer gripping face on the edge of said flexible sheet, and said second centrifugal force producing a sheet-pulling force on said outer mounting arm in a direction to cause said outer mounting arm to pivot, and thereby cause said outer gripping face and said inner gripping face biased to move concurrently in a direction substantially along the peripheral surface of said rotary carrier so as to pull said edge to stretch said sheet tightly on said carrier.

20. The apparatus of claim 19 where said grip-tightening weight is a discrete mass of material embedded within said inner mounting arm.

21. The apparatus of claim 19 where said sheet-pulling weight is a plurality of discrete masses of material attached to said outer mounting arm.

22. The apparatus of claim 21 further including means for mounting said sheet-pulling weight to permit simple removal of said weight from said clamp.

23. The apparatus of claim 14 or 19 wherein said clamp mounting means comprises a single common pivot for said inner and said outer mounting arms.

* * * * *